US006539552B1

(12) United States Patent
Yoshida

(10) Patent No.: US 6,539,552 B1
(45) Date of Patent: Apr. 1, 2003

(54) FLEXIBLE WATERPROOF GLOVE

(76) Inventor: Hisayasu Yoshida, No. 18-10, Ukima 3-chome, Kita-Ku, Tokyo (JP)

( * ) Notice: Subject to any disclaimer, the term of this patent is extended or adjusted under 35 U.S.C. 154(b) by 0 days.

(21) Appl. No.: 09/716,623

(22) Filed: Nov. 20, 2000

(30) Foreign Application Priority Data

Dec. 1, 1999 (JP) ..... 11-342579

(51) Int. Cl.[7] ..... A41D 19/00
(52) U.S. Cl. ..... 2/161.6; 2/167; 2/169
(58) Field of Search ..... 2/16, 158, 159, 2/160, 161.6, 161.7, 163, 164, 167, 168, 169

(56) References Cited

U.S. PATENT DOCUMENTS 3,625,790 A * 12/1971 Ayres ..... 2/159
5,167,038 A * 12/1992 Rinehart ..... 2/164
5,568,656 A * 10/1996 Kim ..... 2/164
5,682,613 A * 11/1997 Dinatale ..... 2/168
5,911,313 A * 6/1999 Gold ..... 2/159

* cited by examiner

*Primary Examiner*—John J. Calvert
*Assistant Examiner*—Katherine Moran

(57) ABSTRACT

A waterproof glove formed of a flexible inner glove body providing a thermal plastic resin film on a base fabric and an flexible outer glove body of the same fabric is thermally unified after the former is inserted into the later. The glove can also be manufactured by a thermal adhesion of the flexible inner glove body providing outwardly the thermal plastic resin film and a flexible outer glove body providing inwardly the same resin film or by a thermal adhession of the flexible inner glove body coating outwardly a thermal plastic resin film having a lower melting point and a flexible outer glove body after insertion of the former into the later. A glove for a skier or a rider in which the thumb is freely movable to grip a stick or a handle, can be manufactured by thermal adhesion of a thumb portion and an other body portion of the glove which was manufactured separately from the same manner and same materials.

50 Claims, 3 Drawing Sheets

Fig. 4
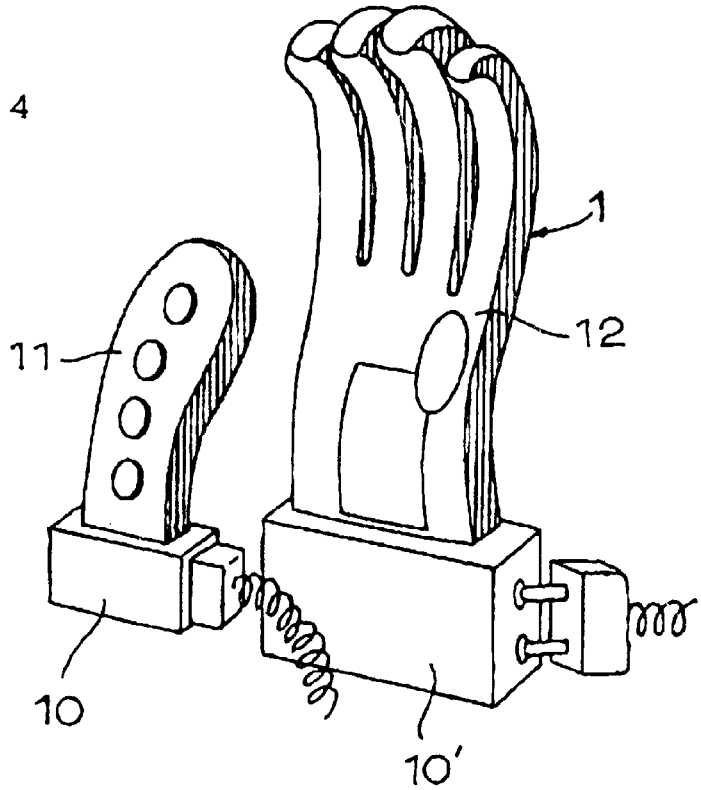
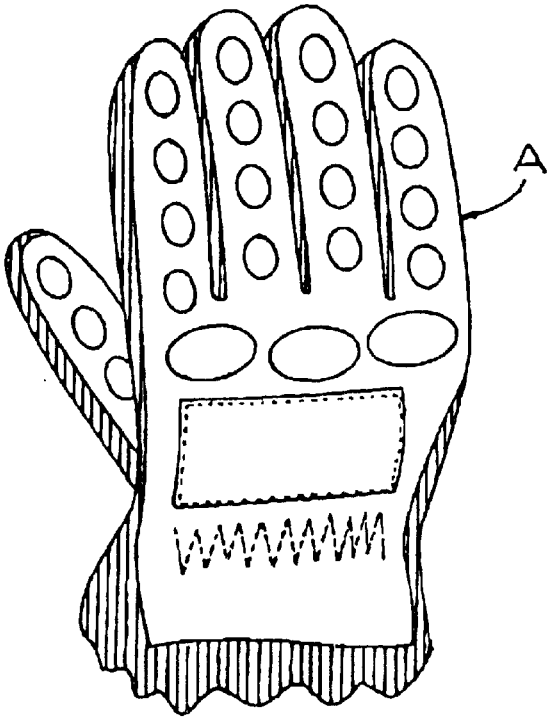
Fig. 5

FLEXIBLE WATERPROOF GLOVE

BACKGROUND OF THE INVENTION

This invention relates to an improved glove and more particularly relates to a full waterproof glove that an easily be manufactured by sewing or knitting, and provides not only a good feeling when worn, but also excellent workability.

There are three processes known to provide a waterproof property for a glove. For example:

(1) An osmotic method of leather, synthetic leather, fabric, knitting material, etc. or products made of those materials, by water repellant liquid, or a waterproof material, or a coating method on the gloves made of those materials by the water repellant liquid or the waterproof material.

(2) A thermal seal method of inward seams on a waterproof glove of the above waterproof material formed, by sewing up and turning over, together with a tape having excellent thermal adhesive property on the seams.

(3) A piling method by sewing or adhering together with three glove bodies of an intermediate filmy glove having a waterproof or a water permeable property, an outer most glove, and inner most glove.

The glove described in (1) may maintain temporarily the waterproof property of its surface material only because it has been permeated or coated by water repellant or waterproof material. However, the seams allow water to permeate into the glove, and even the waterproof surface material cannot be maintained water tight. Also, after repeated usage of the glove, water permeates from here to there in the glove.

The glove described in (2) is made from a process wherein the seam on a back side of the sewed waterproof glove is finally coated with the excellent thermal adhesive tape by a heat treatment to prevent permeation of the water. However, the process is defective because it needs much effort to manufacture the glove, due to an uneven surface of the seam portion to be created with the thermal adhesive tape and uneven surface of the seam. Thus, during use, there is insufficient water tight portion from which the water permeates out from the coated seam.

The glove according to process (3), has intermediate the filmy glove body between the two glove bodies having the waterproof property or a water permeable property, respectively, and is used widely as a glove for a skier or a rider. However, the manufacturing process is troublesome and difficult because all finger points of the glove must be sewed together triply or must be adhesively joined together with a double-sided adhesive tape so that each glove body does not slip off, respectively, as a result of the triple layer of the glove body. Consequently, the waterproof glove could not always eliminate a feeling of a foreign substance from the intermediate glove body due to its separation from the other gloves there between.

BRIEF DESCRIPTION OF THE INVENTION

An embodiment of the invention provides a flexible waterproof glove comprising an inner glove body and an outer glove body, which is thermally unified, respectively, through a waterproof resin film on the former, and during use, has no feeling of a foreign substance from the inner glove. The inner and outer gloves are unified together, after insertion of the former into the later, and are respectively flexible, and are made from a base fabric which can be treated by heat, high frequency, or supersonic processing, and the like, and especially the former is adhered outwardly by a waterproof resin film, which can also be adhered to inwardly of the later by the same thermal treatment.

Another embodiment of the invention is a waterproof glove comprising almost the same components and the same materials, but the inner glove body and the outer glove body provides, respectively, a waterproof resin film outside and inside thereof and both are thermally strongly unified. The glove has no feeling of a foreign substance from the inner glove body there between, after the inner glove body is inserted into the outer glove body so that the resin film surfaces face each other.

Still another embodiment is a waterproof glove comprising almost the same components and the same materials as described above but the thumb portion and other body portion is separately made in the same manner hereinbefore. Both portions are adhered together to manufacture a glove that can hold reliably and has excellent workability when in use, due to the free movement of the thumb portion that is adhered with other body portion through the inner glove body.

In another embodiment a flexible waterproof glove is made from almost the same material and the same processes, except that an adhesive agent is used which has a lower melting point and which is coated thoroughly on an outer surface of the inner glove body.

BRIEF DESCRIPTION OF THE DRAWINGS

The present invention will become apparent from the following description and drawings in which:

FIG. 4 is a perspective view of each thermal setting on separate thermal molds for a thumb portion and other portion of a waterproof glove; and FIG. 5 is a perspective view from a back side of a complete waterproof glove according to an embodiment of the present invention.

DETAILED DESCRIPTION OF THE INVENTION

Figure 1:
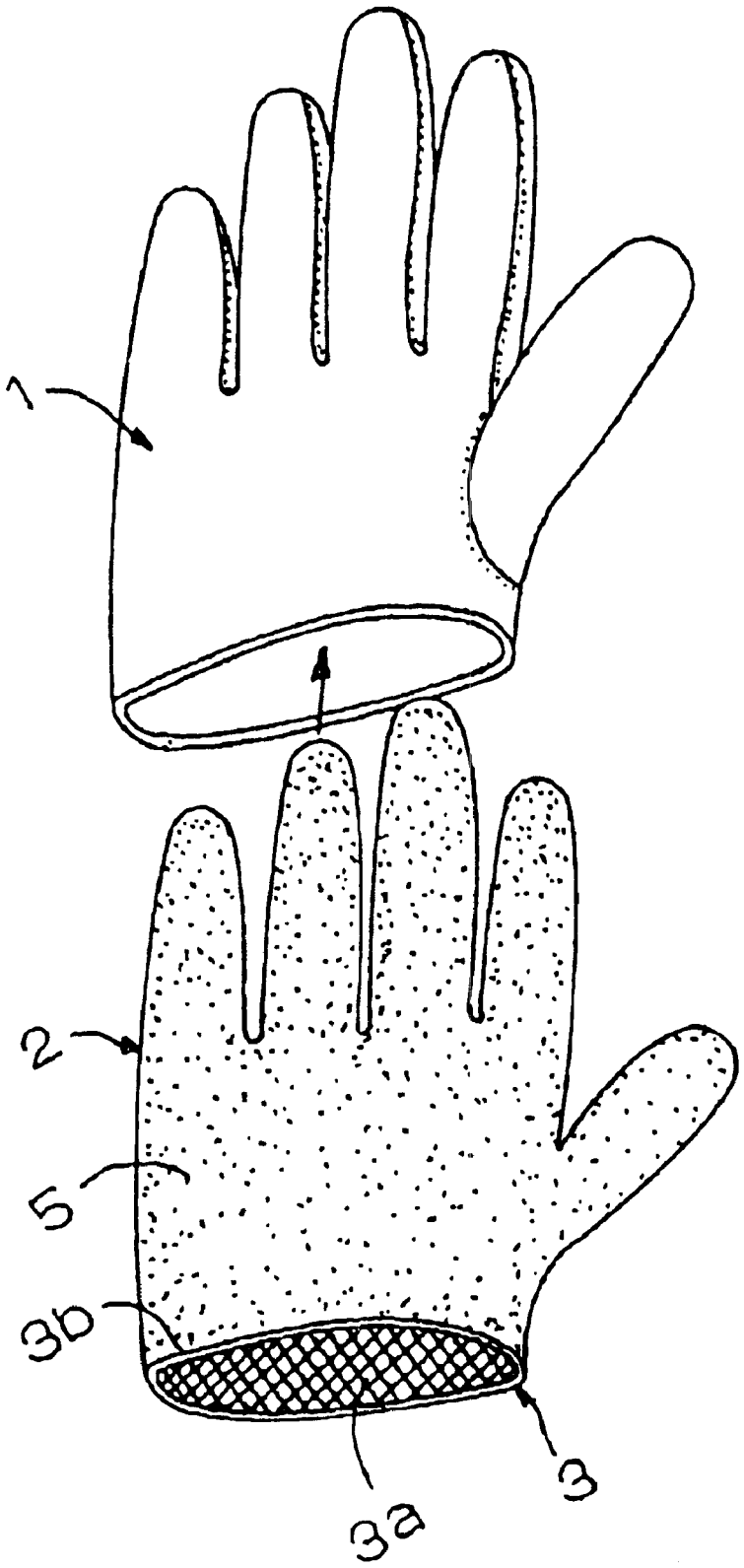
FIG. 1 is a perspective view showing a manufacturing process for a waterproof glove according to an embodiment of the present invention.
Figure 2A:
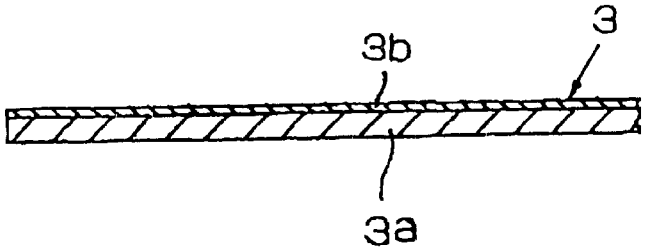
FIG. 2*a* is an elongated sectional view showing a flexible inner glove body.

FIG. 1 shows a flexible waterproof glove comprising an outer glove body 1 and an inner glove body 2, which is manufactured from a fabric 3, as shown in FIG. 2*a*.

The fabric 3 is formed unitarily from a base fabric 3*a*, which is made from a flexible textile cloth, a knit fabric, and the like, a vinyl chloride, poly urethane, nylon, polyethylene, etc., and a waterproof resin film 3*b*. The base fabric and film may be treated by heating or high frequency wave, to thermally form a laminate.

Figure 2B:
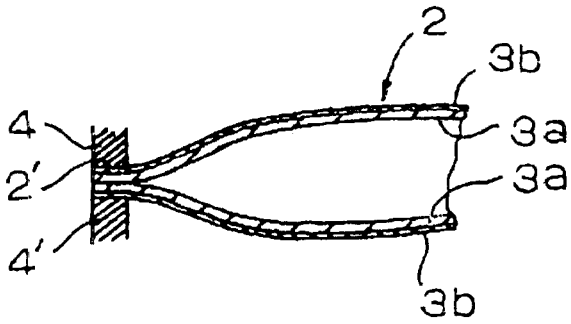
FIG. 2*b* is an elongated sectional view showing a thermal sealing step of an inner glove provided inwardly with a base fabric.
Figure 3:
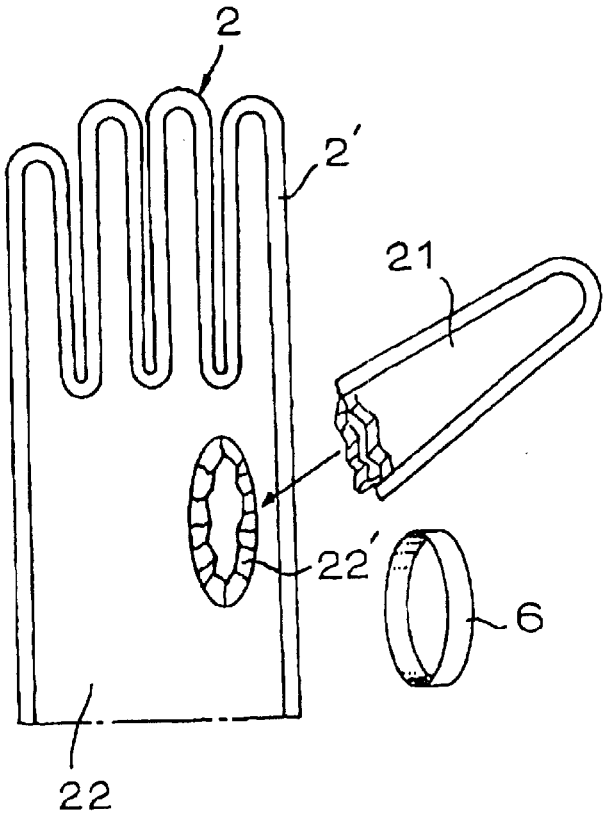
FIG. 3 is a schematic showing an inner glove body having a thumb portion and other body portion made separately and to be adhered together.

In forming the inner glove body 2, two fabrics 3 is piled up, i.e., placed one upon the other, respectively such that the inner surfaces 3*a* face each other, as shown in FIG. 2*b*, and thermally sealed on a glove form of a heating mold 4, 4'. The piled inner glove body may be cut off from outside of the seal so that a margin 2' is formed at the seal, as shown in FIGS. 2 and 3.

The formed piled fabrics 3 in which their inner surfaces 3*a* may at same time, be thermally cut off along the glove mold line by a thermal cutter (not shown) so that the margin also does not remain at the seal.

In order to fit properly and tenderly the glove within the hand of the user, the base fabric 3*a* may be used as an inner surface of the inner glove body 2 as it is formed from the textile cloth, knit fabric and the like.

The waterproof resin film or sheet 3*b* of the inner glove fabric 3 may be a substance that provides not only a waterproof property but also a moisture permeable property, such as Gowatex (Trade Name), or Myclotex (Trade Name). These materials are effective as the inner glove body of the waterproof glove for a rider or skier, due to their waterproof property and moisture permeable property.

The outer glove body 1 may be made from fabrics such as a leather, a synthetic leather, a textile cloth, a knit fabric, etc., and it may be a glove like a skier's or a rider's glove, and may use a white cotton glove for working, even if it is not desirable.

The outer glove body I and the inner glove body 2 may be adhered together by thermal setting of the waterproof resin film 3*b* outside of the inner glove body 2.

The outer glove body 1 also may be formed from a fabric material which is united with a thermal plastic resin film on one side of the leather, the synthetic leather, the textile cloth, the knit fabric, and the like. Thereafter the outer resin film of the inner glove body 2 and the inner resin film of the outer glove body 1 are contacted respectively, and both may be melted to strongly unite the inner and outer glove bodies. In this case, heat, high frequency or supersonic wave may be applied from the inside of the inner glove body 2 or from the outside of the outer glove body 1 and or from the both sides of the both glove bodies at the same time.

The outer glove body 1 and the inner glove body 2 may also be adhered together in a body with a hot-melt agent 5, having a lower melting point, coated on the outer surface of the inner glove body 2, by a thermal setting means such as an electric heater, high frequency processes or supersonic wave processor or welder, from an outside surface of the outer glove body 1 and an inside surface of the inner glove body 2, after insertion of the later into the former.

Thermal setting is effective because it can provide unitary adherence of the outer and inner glove bodies, in a range of lower temperature than the setting that uses the resin film to be melted to adhere the inner and outer glove bodies. In order to obtain uniform and natural adhesion of the inner and outer glove bodies, it is also effective to coat the hot-melt agent 5 throughout all outer surfaces of the inner glove body 2.

The waterproof glove may also be manufactured in a body by sewing the margin 2' to seal the inner glove body 2, with the outer glove body 1. It is necessary to eliminate a feeling on the hand of a user of a foreign substance on the inner glove body when the glove is worn by thermal setting in the outer and inner glove body 1 and 2. Coating uniformly the hot-melt agent 5 on the outer surface of the inner glove body 2 can eliminate this feeling.

The glove can be also manufactured by a second manner wherein a thumb portion 21 and the other main glove body portion 22 are separately manufactured as shown in FIG. 3. The inner glove body 2 is manufactured by putting the fabric 3 upon the other same fabric 3 so that their respective base fabrics 3*a* face each other, and are heat set together and are cut off along a glove form by heating molds 4, 4'. Of course, a margin 22' is furnished for the thumb portion 21 and may be arranged in the manufacture of the other main portion 22.

In the outer glove body 1, a thumb portion 11 is also manufactured separately from the other main portion 12 of the outer glove body 1. The thumb portion 21 and the other main portion 22 of the inner glove body 2 thereafter is put on a heater set 10 for the former and a same set 10' for the later, and is covered with thumb portion 11 and the other main portion 12 of the outer glove body 1 respectively, after both surfaces of both portions of the inner glove body 2 are coated by the hot-melt agent 5, as shown in FIG. 4. Both portions thereafter are treated electrically, and finished to the thumb portion and the other main portion of the waterproof glove such that the respective same portion of the inner glove body and outer glove body are completely adhered in a body. The finished both portions are adhered respectively with a connecting material 6 that easily adhere by heating or high frequency treatment.

Thus, the second manner can provide a waterproof glove A as shown in FIG. 5, in which the thumb can freely move when it was put on the hand even though the left side and right side must be manufactured separately. The second manner, consequently, can also provide superior glove for a rider or a skier in which a handle or a stick can easily be held and operated.

There has been described and pointed out the fundamental waterproof gloves of embodiments of the invention it will be understood that various omissions an substitutions and changes in the form and details of the glove disclosed may be made by those skilled in the art, without departing from the spirit of the invention. The invention, therefore, is limited only as indicated by scope of the following claims.

What is claimed is:

1. A flexible water-proof glove comprising:

(a) an outer glove body which may be fit on a user's hand;

(b) an inner glove body which may be fit on the user's hand of a flexible base material and coated on an outer surface thereof with a first water-proof material;

(c) the outer surface of the inner glove body is coated with a hot-melt agent having a melting point lower than the first water-proof material;

(d) wherein when the inner glove body is fully inserted into the outer glove body, the inner glove body and the outer glove body are thermally adhered together by the first water-proof material.

2. The glove according to claim 1 wherein the outer glove body is coated on inner surface thereof with a second water-proof material.

3. The glove according to claim 1 wherein the inner glove body comprises:

a laminate formed by a base fabric coated with the first water-proof material.

4. The glove according to claim 3 wherein the inner glove body is formed by two laminates thermally joined at marginal edges of each laminate.

5. The glove according to claim 1 wherein the inner and outer glove bodies are formed without a thumb portion, the thumb portion being separately adhered to each body after the inner and outer bodies are formed.

6. The glove according to claim 1 wherein the inner glove body and the outer glove body are thermally adhered together by a process of applying heat or a high frequency or a supersonic wave.

7. The glove according to claim 3 wherein the base fabric is selected from the group consisting of cloth, knit fabric, vinyl chloride, polyurethane, nylon and polyethylene.

8. The glove according to claim 1 wherein the outer glove body is selected from the group consisting of leather, cloth and knit fabric.

9. A method for making a flexible water-proof glove comprising:

(a) forming an outer glove body which is capable of fitting onto a user's hand;

(b) forming an inner glove body of a base material which is capable of fitting onto the user's hand;

(c) coating the outer surface of the base material with a first waterproof material;

(d) coating the outer surface of the inner glove body with a hot-melt agent having a melting point lower than the melting point of the first water-proof material;

(e) fully inserting the inner glove body into the outer glove body; and (f) applying a thermal source to the outer and inner glove body to cause the material to adhere together the inner and outer glove bodies.

10. The method according to claim 9 comprising:

coating the inner surface of the outer glove body with a second water-proof material.

11. The method according to claim 9 wherein the inner glove body is formed by a laminate of a base fabric and the first water-proof material.

12. The method according to claim 9 wherein the thermal source is applied to an outer surface of the outer glove body.

13. The method according to claim 9 wherein the thermal source is applied to an inside surface of the inner glove body.

14. The method according to claim 9 wherein the thermal source is applied to the outer surface of the outer glove body and to the inside surface of the inner glove body.

15. The method according to claim 11 comprising:

forming the inner glove body by thermally joining two laminates at marginal edges of each laminate.

16. The method according to claim 9 comprising:

forming the inner and outer glove bodies without a thumb portion;

separately forming the thumb portion; and thermally adhering the thumb portion to the inner and outer bodies.

17. The method according to claim 9 wherein the thermal source is a source selected from the group consisting of heat, high frequency, and supersonic wave.

18. The method according to claim 9 wherein the inner and outer glove bodies are each formed on a heated mold.

19. The method according to claim 9 wherein the inner and outer glove bodies are adhered in a thermal mold.

20. A flexible waterproof glove comprising:

(a) an outer glove body having an inner surface and which may fit on a user's hand;

(b) an inner glove body which may fit on a user's hand, the inner glove body comprising:

(1) two laminates joined at marginal edges of each laminate;

(2) each laminate having a flexible base material and coated on an outer surface thereof with a first water-proof material; and (3) the coating of the first waterproof material having an extent substantially the same as an extent of the inner surface of the outer glove body;

(c) wherein when the inner glove body is fully inserted into the outer glove body, the inner glove body and the outer glove body are adhered together by the first waterproof material.

21. The glove according to claim 20 wherein the outer glove body is coated on inner surface thereof with a second waterproof material.

22. The glove according to clam 20 wherein the outer glove body is formed from of material that is not the same as the material of the inner glove body.

23. The glove according to claim 21 wherein the first and second waterproof material is the same.

24. The glove according to claim 20 wherein the outer surface of the inner glove body is coated with a hot-melt agent having a melting point lower than the first waterproof material.

25. The glove according to claim 20 wherein the inner and outer glove bodies are formed without a thumb portion, the thumb portion being separately adhered to each body after the inner and outer bodies are formed.

26. The glove according to claim 20 wherein the inner glove body and the outer glove body are thermally adhered together by a process of applying an adhering source selected from the group consisting of heat, high frequency and supersonic wave.

27. The glove according to claim 20 wherein the base material is selected from the group consisting of cloth, knit fabric, vinyl chloride, polyurethane, nylon and polyethylene.

28. The glove according to claim 20 wherein the outer glove body is material selected from the group consisting of leather, cloth and knit fabric.

29. The glove according to claim 20 wherein the inner glove base material for each laminate is the same.

30. The glove according to claim 20 wherein the inner glove base material for each laminate is not the same.

31. The glove according to clam 20 wherein the outer glove body is formed from of material that is the same as the material of the inner glove body.

32. The glove according to claim 13 wherein the first and second waterproof material is not the same.

33. A method for making a flexible waterproof glove comprising:

(a) forming an outer glove body which is capable of fitting onto a user's hand;

(b) forming a first laminate of a first base material and a first waterproof material, the first waterproof material having an extent substantially equal to the first base material;

(c) forming a second laminate of a second base material and a second waterproof material, the second water-proof material having an extent substantially equal to the second base material;

(d) joining the first and second laminates at marginal edges of each laminate to form an inner glove body which is capable of fitting onto the user's hand, the first waterproof material being an outer surface of the inner glove body;

(e) fully inserting the inner glove body into the outer glove body; and (f) applying a thermal source to the outer and inner glove body to cause the first waterproof material to adhere together the inner and outer glove bodies.

34. The method according to claim 27 comprising:

coating the inner surface of the outer glove body with a second water-proof material.

35. The method according to claim 27 comprising:

coating the outer surface of the inner glove body with a hot-melt agent having a melting point lower than the melting point of the first waterproof material.

36. The method according to claim 27 wherein the thermal source is applied to an outer surface of the outer glove body.

37. The method according to claim 27 wherein the thermal source is applied to an inside surface of the inner glove body.

38. The method according to claim 27 wherein the thermal source is applied to the outer surface of the outer glove body and to the inside surface of the inner glove body.

39. The method according to claim 27 wherein the thermal source is applied to at least one surface of the inner glove body.

40. The method according to claim 27 wherein the thermal source is applied to at least one surface of the outer glove body.

41. The method according to claim 27 comprising:

forming the inner and outer glove bodies without a thumb portion;

separately forming the thumb portion; and thermally adhering the thumb portion to the inner and outer bodies.

42. The method according to claim 27 wherein the thermal source is a source selected from the group consisting of heat, high frequency and supersonic wave.

43. The method according to claim 27 wherein the inner and outer glove bodies are each formed on a heated mold.

44. The method according to claim 27 wherein the inner and outer glove bodies are adhered in a thermal mold.

45. The method according to claim 27 wherein the first and second base materials are the same.

46. The method according to claim 27 wherein the first and second base materials are not the same.

47. The method according to clam 27 wherein the outer glove body is formed from of material that is the same as the material of the inner glove body.

48. The method according to clam 27 wherein the outer glove body is formed from of material that is not the same as the material of the inner glove body.

49. The method according to claim 28 wherein the first and second water-proof material is the same.

50. The method according to claim 28 wherein the first and second water-proof material is not the same.

* * * * *